US006215054B1

(12) United States Patent
Woodhouse et al.

(10) Patent No.: US 6,215,054 B1
(45) Date of Patent: Apr. 10, 2001

(54) MUSICAL INSTRUMENT SUPPORT STAND

(76) Inventors: Kevin Scott Woodhouse, 25 Milton St., San Francisco, CA (US) 94112; Daniel Lythcott-Haims, 172 Fir St., San Carlos, CA (US) 94070

( * ) Notice: Subject to any disclaimer, the term of this patent is extended or adjusted under 35 U.S.C. 154(b) by 0 days.

(21) Appl. No.: 09/596,308

(22) Filed: Jun. 14, 2000

Related U.S. Application Data

(60) Provisional application No. 60/139,195, filed on Jun. 14, 1999.

(51) Int. Cl.[7] ..... G10C 3/12

(52) U.S. Cl. ..... 84/421; 84/327; 84/453; 84/280

(58) Field of Search ..... 84/421, 327, 453, 84/280, 281; 297/19, 158.5, 159.1, 173; D17/99; 248/166, 371, 167, 169, 170, 172, 176.1

(56) References Cited

U.S. PATENT DOCUMENTS

| | | | | |
|---|---|---|---|---|
| 3,405,587 | * | 10/1968 | Meazzi et al. | 84/421 |
| 4,392,627 | | 7/1983 | van den Broek . | |
| 4,732,070 | | 3/1988 | Yamashita . | |
| 4,829,874 | | 5/1989 | Hoshino . | |
| 5,181,686 | | 1/1993 | Barthel . | |
| 5,335,575 | | 8/1994 | Hoshino . | |
| 5,375,497 | * | 12/1994 | Pirchio et al. | 84/327 |
| 5,383,634 | * | 1/1995 | Liao | 248/166 |
| 5,467,680 | * | 11/1995 | Kurosaki | 84/421 |

FOREIGN PATENT DOCUMENTS

| | | | | |
|---|---|---|---|---|
| 3 118 806 | * | 12/1982 | (DE) | 84/421 |

OTHER PUBLICATIONS

Chap Ostrander, "Good Things Really Do Come in Small Packages," Modern Drummer, pp. 45–47, (Jul. 14, 1999).

* cited by examiner

*Primary Examiner*—Robert E. Nappi
*Assistant Examiner*—Kim Lockett
(74) *Attorney, Agent, or Firm*—Gene Scott - Patent Law & Venture Group

(57) ABSTRACT

An apparatus for supporting a musical instrument during play comprises a hub pivotally engaging a plurality of horizontally disposed arms which extend radially outwardly from the hub. At least one of the arms is adjustable in length. A plurality of vertically disposed legs where, at least one of the legs is adjustable in length, are joined at the free ends of the arms. The hub provides a base portion and a cover portion and the arms are sandwiched between them. The cover may be tightened down on the base portion so as to lock the arms of the apparatus in a position of choice for best supporting the musical instrument. The base portion further provides a horizontal step extending downwardly in a position for engaging a pedal and striker assembly. The pedal and striker assembly are positioned for striking a musical instrument supported by the legs.

8 Claims, 4 Drawing Sheets

MUSICAL INSTRUMENT SUPPORT STAND

The present application claims the priority date of a previously filed provisional patent application Ser. No. 60/139,195 and an assigned filing date of Jun. 14, 1999 and which contains subject matter substantially the same as that described and claimed in the present application.

BACKGROUND OF THE INVENTION

1. Field of the Invention

This invention relates generally to stands and support devices and more particularly to an apparatus for supporting a musical instrument during play.

2. Description of Related Art

The following art defines the present state of this field:

Van den Broek, U.S. Pat. No. 4,392,627 describes a dismantleable boat cradle comprising a frame which forms a closed rectangle and is constructed from profile sections with non-circular cross-section which are connected with each other at the comer points by couplings, which are built up from three tube sections which are mutually perpendicular to each other and which accommodate two frame sections and an upright, of which at least one is open at both ends, said uprights having an adjustable height and carrying support heads.

Yamashita, U.S. Pat. No. 4,732,070 describes an electronic bass drum mainly constructed by two front legs which stand substantially vertically and are parallel to each other, two rear legs whose one ends are connected to the front legs and whose other ends extend obliquely downward, a pad whose back surface is fixed to the front legs and whose front surface is striken by a player and a pickup which is attached to the back surface. The pickup detects a vibration of the pad caused by the player's strike and outputs a detection signal representing electrically the vibration. Drum sound is realized by driving a sound source such as a PCM sound source, a FM sound source in response to the detection signal.

Hoshino, U.S. Pat. No. 4,829,874 describes a bass drum support to position the drum beating spot at a desired height, to prevent stress at the connection of the drum to a foot pedal operated drum beater and to minimize transmission of vibration from the drum body to the support and the foot pedal. A front support leg is supported at the center of the front end of the body of the drum through a vibration absorption set, made, for example, of rubber. A pair of rear support legs extend to the rear part of the drum body and are resilient. The lengths of the legs are adjustable. The rear legs are inclined forwardly of the drum body. Clamping of the front end of the drum by the drum beater pedal assembly is avoided.

Barthel, U.S. Pat. No. 5,181,686 describes a support housing including a plurality of radially projecting arm members mounted to the support housing, with the arm members formed of a first and second arm each slidable relative to one another, with each arm including an orthogonally and upwardly oriented projection. A modification of the invention includes projections formed with a polymeric spring-biased tip to resiliently support a workpiece minimizing marring of the workpiece during a drying procedure.

Hoshino, U.S. Pat. No. 5,335,575 describes an easily foldable conga stand that takes little space and facilitates the setup of a conga. The conga stand comprises three leg members each having on its upper end a presser portion and on its lower end a leg lower hinge portion, leg slide members each attached to each leg member and provided with a hinge portion, a shank member having a lower hinge portion on its lower end, a shank upper slide member attached to the shank member and provided with a hinge portion, a shank lower slide member attached to the shank member and provided with a hinge portion, three holding stays both ends of each being pivoted to the hinge portion of the leg slide member and the hinge portion of the shank upper slide member, respectively, three support stays both ends of each being pivoted to the leg lower hinge portion and the hinge portion of the shank lower slide member, respectively, and three auxiliary stays both ends of each being pivoted to the lower hinge portion of the shank member and the middle of the support stay, respectively.

Kurosaki, U.S. Pat. No. 5,467,680 describes the construction of a snare drum stand having a lower support and an upper center post, four sets of arms are mounted overhead the center post with 90 degrees center angle intervals whilst extending radially outwords. Distant positioning of the radial arms form lugs on the annular brim of a drum allows easy mounting of the drum onto the stand and easy tension adjustment via the lugs.

Ostrander, Chap, "Good things really do come in small packages," Modern Drummer magazine, July 1999, pp 45–47 describes and shows a drum support mount with means for attaching a pedal and striker assembly.

The prior art teaches upright adjustable stands, stands with multiple folding legs, supports with legs extending in radial array, drum supports, supports for boats and supports for drums with attached peddle and striker. However, the prior art does not teach a drum support having the structure and related advantages of the present invention as described in the following summary.

SUMMARY OF THE INVENTION

The present invention teaches certain benefits in construction and use which give rise to the objectives described below.

The present invention is an apparatus capable of supporting a musical instrument during play and comprises a hub pivotally engaging a plurality of horizontally disposed arms which extend radially outwardly from the hub. Preferably two of the arms are adjustable in length. A plurality of vertically disposed legs are preferably adjustable in length and are joined at the free ends of the arms. The hub provides a base portion and a cover portion and the arms are sandwiched between them. The cover may be tightened down on the base portion so as to lock the arms of the apparatus in a position of choice for best supporting the musical instrument. The base portion further provides a horizontal step extending downwardly in a position for engaging a standard, commercially available pedal and striker assembly. The pedal and striker assembly are positionable for striking the musical instrument as supported by the legs.

A primary objective of the present invention is to provide a musical instrument supporting stand having advantages not taught by the prior art.

Another objective is to provide such an invention capable of supporting a variety of sizes and types of musical instruments.

A further objective is to provide such an invention capable of folding into a very small size for compact storage and improved portability.

A still further objective is to provide such an invention of low manufacturing cost and very high adaptability.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
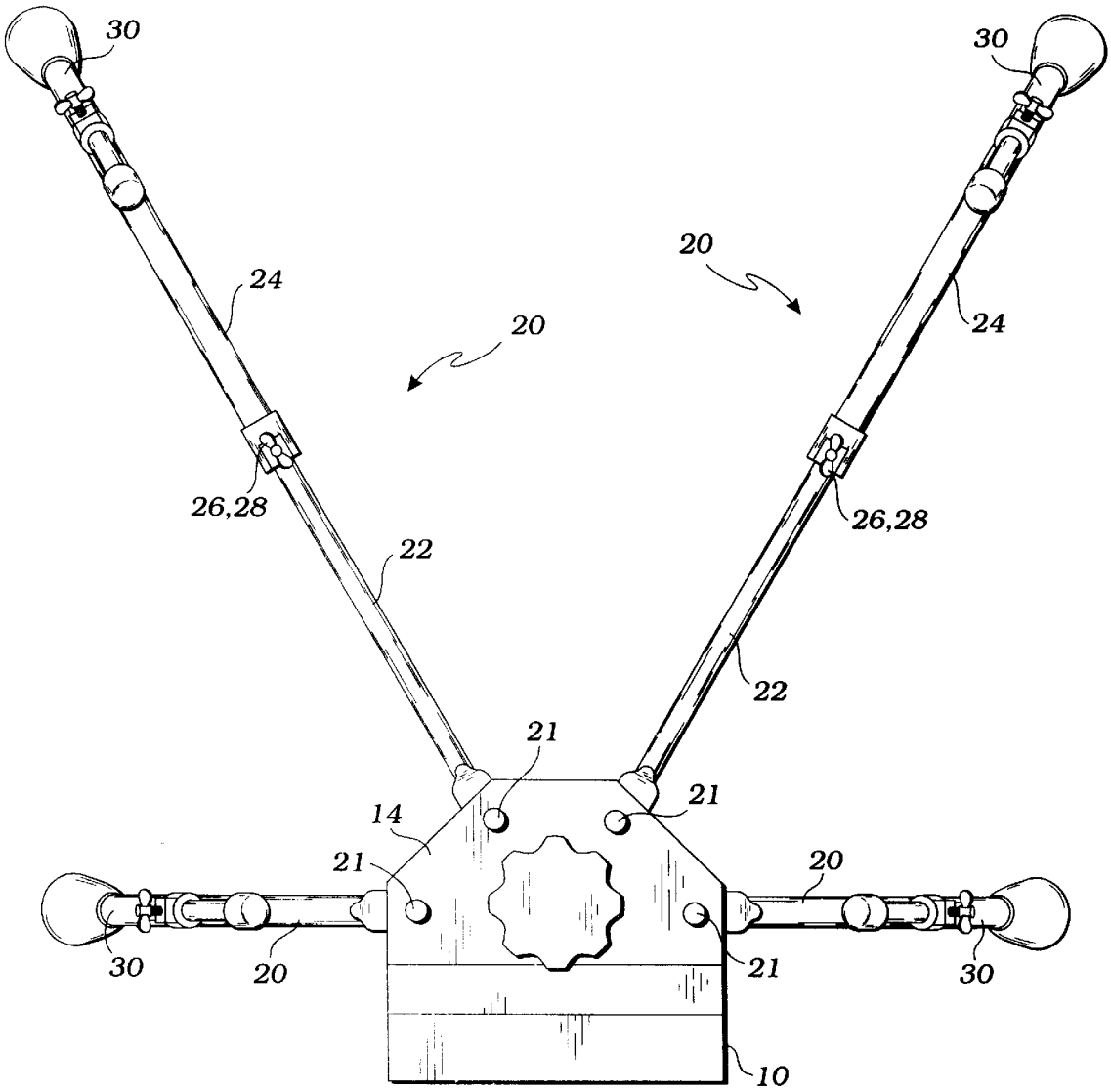
FIG. 1 is a top plan view of the preferred embodiment of the invention.

The above described drawing FIGS. 1–4 illustrate the invention, an apparatus for supporting a musical instrument (not a part of the instant invention) during play.

The apparatus comprises a hub 10 pivotally engaging a plurality of horizontally disposed arms 20, which extend radially outwardly from the hub 10. The method of pivotal attachment of the arms 20 with the hub 10 is preferably a pin 21 arrangement as would be easily enabled by one of skill in the art. At least one of the arms 20, and preferably two of the arms 20 are adjustable in length as is clearly shown in FIG. 1. The means for such length adjustment of the arms 20 is preferably their construction comprising, a rod 22 slidably mounted within a tube 24, with a finger screw 26 tightenable against the rod 22 through a nut 28, as is well known in the prior art. A plurality of near vertically disposed legs 30 are provided. At least one of the legs 30, and preferably all, are adjustable in length in the same manner of construction as the arms 20. Each one of the legs 30 is joined with one of the arms 20 at its free end 25. It has been discovered that with the legs angled at about 20 degrees off vertical toward the hub 10, the apparatus is able to support a wider array of musical instruments with greater stability.

Figure 3:
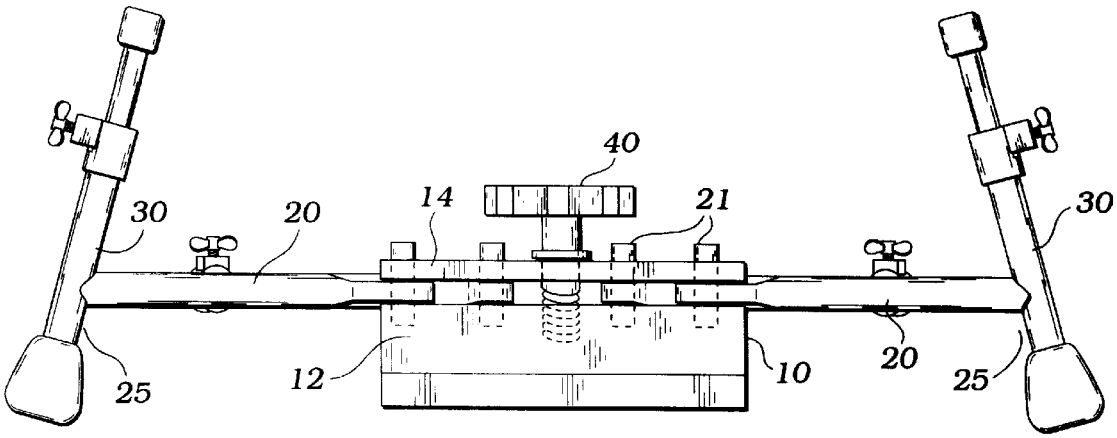
FIG. 3 is a front elevational view thereof.
Figure 4:
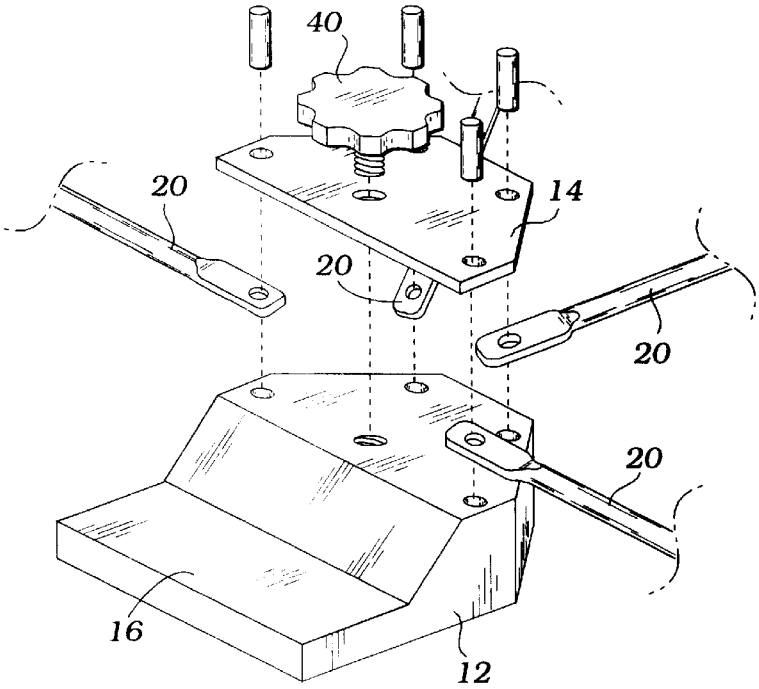
FIG. 4 is a partial exploded view thereof.

The hub 10 provides a base portion 12 and a cover portion 14. The arms 20 are sandwiched between the base portion and the cover portion as best seen in FIG. 3. A means for tightening 40, such as a hand knob is engaged with the hub 10 via screw threads, so that rotation of the hand knob 40 draws the base and cover portions 12, 14 closer together so as to lock the arms 20 of the apparatus in positions of choice for best supporting the musical instrument. Clearly, many different types and sizes of musical instruments may be supported on the instant apparatus due to the large number of possible positions and lengths of the arms 20. The base portion 12 further provides a horizontal step 16 extending downwardly for accepting a pedal and striker assembly 50 of a type well known in the musical equipment industry especially for drum ensembles. The pedal and striker assembly 50 may be considered a part of the present invention. Whether added to, or as an integral part of the invention, the pedal and striker assembly 50 provides a clamp 52 adapted for engagement with the step 16 of the base portion 12. The clamp 52 is enabled by its size and configuration for positioning a striker 54 of the pedal and striker assembly 50 for striking a musical instrument supported by the legs 30. As stated, such an instrument is usually a drum.

Figure 2:
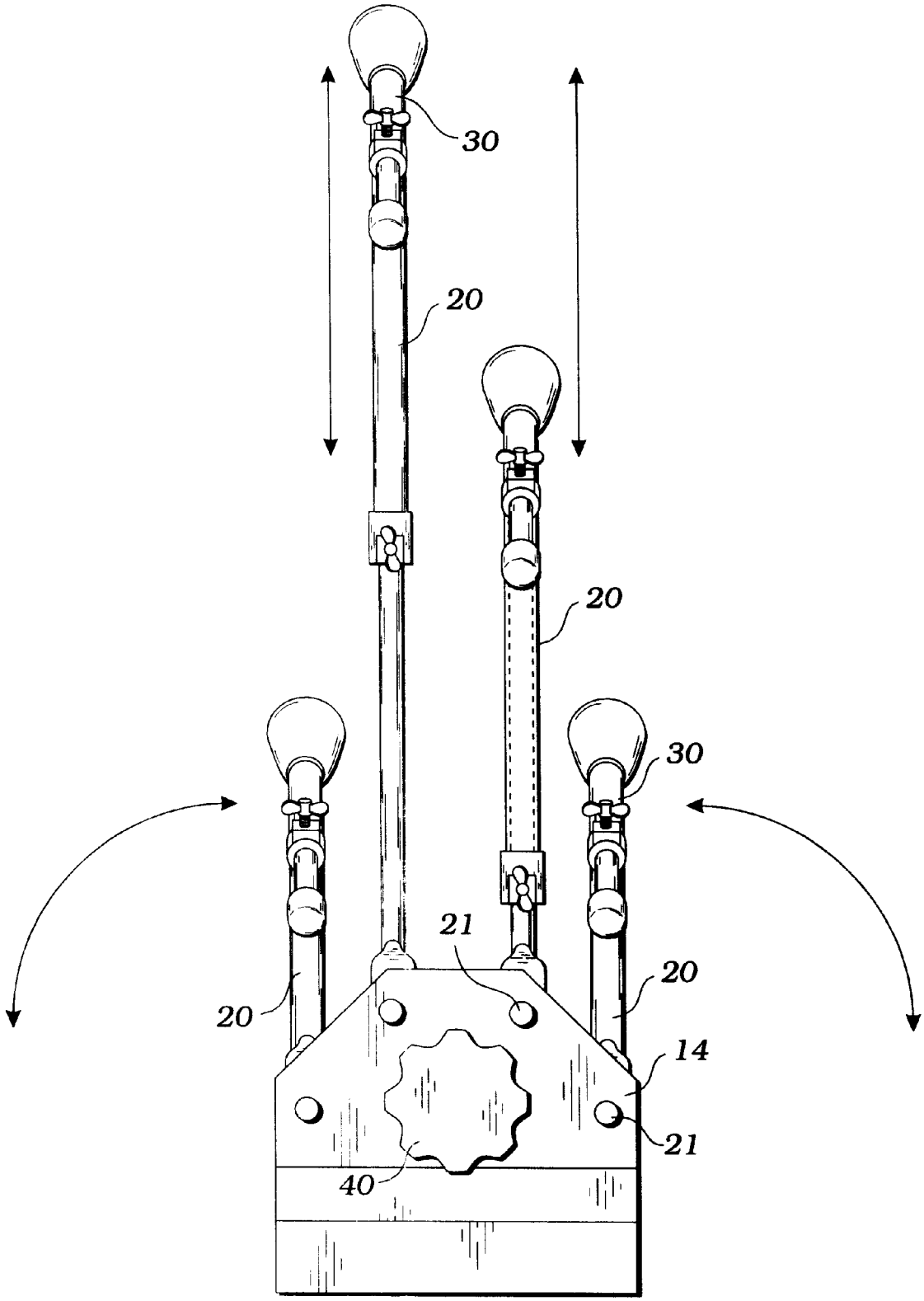
FIG. 2 is a top plan view thereof as folded.

The arms 20 are engaged with the hub 10 in a manner enabling the arms 20 to be pivoted horizontally in a common direction so as to be placed in side-by-side alignment for compact storage of the apparatus. This is best seen in FIG. 2.

Figure 5:
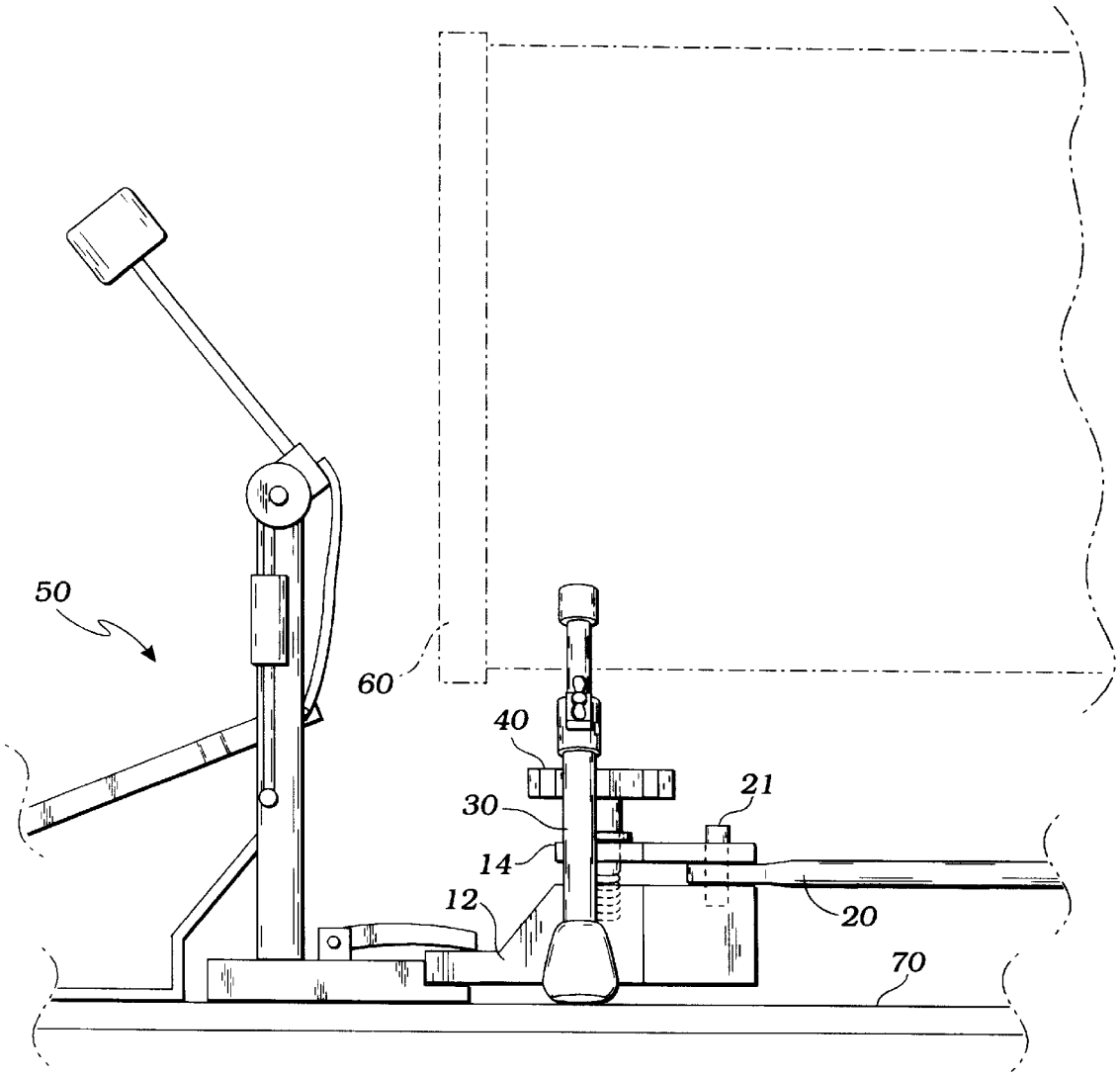
FIG. 5 is a side elevational view thereof.

In operation, the apparatus, starting from its folded configuration (FIG. 2) is removed from a storage bag (not shown) and is placed on a supporting surface such as a floor or stage, etc., with the hand knob 40 facing upwardly. Next, the hand knob 40 is loosened so that the arms 20 are able to be positioned at will. With the arms 20 rotated to desired positions, as shown for instance, in FIG. 1, the extensible arms are adjusted to a desired length and finger screws 26 are tightened to maintain the selected arm length. Next, the legs 30 are adjusted, in the same manner, as to height, for accommodation of the musical instrument. Finally, the instrument is placed on the legs. If used, the pedal and striker assembly 50 is next clamped in place on the horizontal step 16 as shown in FIG. 5.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for supporting a musical instrument during play, the apparatus comprising:

a hub pivotally engaging a plurality of horizontally disposed arms, the arms extending radially outwardly from the hub, at least one of the arms being adjustable in length;

a plurality of approximately vertically disposed legs, at least one of the legs being adjustable in length, each one of the legs joined with one of the arms at a free end of the arm;

the hub providing a base portion and a cover portion, the arms sandwiched therebetween;

a means for tightening the cover portion on the base portion so as to lock the arms of the apparatus in a position of choice for best supporting the musical instrument;

the base portion further providing a horizontal step extending downwardly therefrom, for accepting a pedal and striker assembly.

2. The apparatus of claim 1 further comprising the pedal and striker assembly engaged with the step of the base portion.

3. The apparatus of claim 2 wherein the pedal and striker assembly provide a clamp for engagement of the step of the base portion, the clamp enabled for positioning a striker of the pedal and striker assembly for striking a musical instrument supported by the legs.

4. The apparatus of claim 1 wherein the arms are engaged with the hub in a manner enabling the arms to be pivoted in a common direction in side-by-side alignment for compact storage of the apparatus.

5. The apparatus of claim 1 wherein the legs are set at an angle of approximately 20 degrees off vertical in the direction of the hub.

6. An apparatus for supporting a musical instrument during play, the apparatus comprising:

a hub pivotally engaging a plurality of horizontally disposed arms, the arms extending radially outwardly from the hub, at least one of the arms being adjustable in length;

a plurality of vertically disposed legs, at least one of the legs being adjustable in length, each one of the legs joined with one of the arms at a free end of the arm;

the hub providing a base portion and a cover portion, the arms sandwiched therebetween;

a means for tightening the cover portion on the base portion so as to lock the arms of the apparatus in a position of choice for best supporting the musical instrument;

the base portion further providing a horizontal step extending downwardly therefrom, the horizontal step engaged with a pedal and striker assembly, a striker of the pedal and striker assembly positioned for striking a musical instrument supported by the legs.

7. The apparatus of claim 6 wherein the arms are engaged with the hub in a manner enabling the arms to be pivoted in a common direction in side-by-side alignment for compact storage of the apparatus.

8. The apparatus of claim 6 wherein the legs are set at an angle of approximately 20 degrees off vertical in the direction of the hub.

* * * * *